United States Patent [19]

Hara et al.

[11] 4,179,083

[45] Dec. 18, 1979

[54] WIRE FORCING DEVICE FOR A WIRE TAKE UP APPARATUS

[75] Inventors: Ryoichi Hara, Chiba; Masamichi Yajima; Chiaki Akai, both of Ichihara; Takuzo Matsumoto, Osaka, all of Japan

[73] Assignees: The Furukawa Electric Co., Ltd., Tokyo; Sumitomo Electric Industries, Ltd., Osaka, both of Japan

[21] Appl. No.: 968,975

[22] Filed: Dec. 13, 1978

Related U.S. Application Data

[62] Division of Ser. No. 772,339, Feb. 25, 1977, Pat. No. 4,143,834.

[30] Foreign Application Priority Data

Feb. 25, 1976 [JP] Japan ..... 51-20521
Feb. 25, 1976 [JP] Japan ..... 51-20522

[51] Int. Cl.[2] ..... B65H 54/28

[52] U.S. Cl. ..... 242/158 R; 242/158.2; 242/158.4 R

[58] Field of Search ..... 242/158 R, 158 B, 158 F, 242/158.1, 158.2, 158.3, 158.4 R, 158.4 A, 158.5, 157.1, 25 R, 7.14, 7.15, 7.16, 2, 3

[56] References Cited

U.S. PATENT DOCUMENTS

| | | | |
|---|---|---|---|
| 2,988,292 | 6/1961 | Bliss | 242/25 R |
| 3,146,962 | 9/1964 | Hardwick | 242/2 |
| 3,312,421 | 4/1967 | Kerr et al. | 242/158.4 R |
| 3,507,458 | 4/1970 | Merchant et al. | 242/158.4 R |
| 3,951,355 | 4/1976 | Morioka et al. | 242/158.4 R X |

*Primary Examiner*—Stanley N. Gilreath
*Attorney, Agent, or Firm*—Wenderoth, Lind & Ponack

[57] ABSTRACT

This invention relates to a wire forcing device on a distributor of a wire take up apparatus to take up a wire such as an electric cable on a reel in an arranged manner. The wire forcing device has wire engaging means to force a first turn of a wire winding layer against either end of the reel. The wire engaging means may comprise a pair of guide members of the distributor, or may be separate from the guide members. If the wire engaging means comprises the guide members of the distributor, while the wire is taken up on the reel between the flanges thereof, the wire engaging means guides the wire for transversely distributing the wire, and just before a first turn of a new winding layer begins to be wound adjacent to either of the reel flanges or while the first turn of the new winding layer is wound, either of the guide members forces the wire against the corresponding reel flange. If the wire engaging means is separate from the guide members of the distributor, just before the first turn of the new winding layer begins to be wound or while it is being wound, the wire engaging means is advanced so that it forces the wire against either of the reel flanges with the wire held between the wire engaging means and the reel flange. While the wire is normally wound, the wire engaging means is retracted from the reel flanges.

3 Claims, 15 Drawing Figures

WIRE FORCING DEVICE FOR A WIRE TAKE UP APPARATUS

This is a divisional application of the applicants' copending application Ser. No. 772,339 filed on Feb. 25, 1977, now U.S. Pat. No. 4,143,834.

BACKGROUND OF THE INVENTION

A distributor of a wire take up apparatus is adapted to transversely guide a wire each time a turn of the wire is wound for taking up the wire on a reel in an arranged manner. Since at the beginning of a first turn of the wire as a new winding layer adjacent to either of the flanges of the reel, the first turn of the new winding layer has a tendency to be away from the corresponding reel flange due to a torsional rigidity of the wire, the first turn of the wire is required to be forced against the reel flanges so as to be close thereto. In the prior art, an operator or operators enter between the distributor and the reel and manually force the wire against either of the reel flanges. Thus, the operation of forcing the wire against the reel flanges is extremely dangerous.

Of late, a wire forcing device has been proposed which automatically forces the first turn of each of the winding layers against either of the reel flanges (Japanese Application Publication No. 17,478/1970). However, this prior wire forcing device has been wholly separate from the distributor, and therefore, it should be adjusted in position or components of the device should be replaced, based on various parameters of the reel such as the axial length of the reel and the diameter of the reel flanges. Thus, it has been inconvenient to deal with the prior wire forcing device.

SUMMARY OF THE INVENTION

Accordingly, it is a principal object of the present invention to provide a wire forcing device for a wire take up apparatus adapted to be commonly used for reels of various parameters without any adjustment by mounting the device on a distributor of the wire take up apparatus.

It is another object of the present invention to provide a wire forcing device for a wire take up apparatus which can be economically provided only by simply modifying a distributor of the wire take up apparatus.

In accordance with the invention, there is provided a wire forcing device for a wire take up apparatus comprising a distributor to guide a wire to be wound on a reel in a manner parallel to the axis of said reel, said device comprising wire engaging means mounted on said distributor to force said wire against either of flanges of said reel; and urging means to said wire engaging means to either of said flanges whereby a first turn of each of the winding layers of wire is close to either of said flanges. The wire engaging means may comprise a pair of guide members of the distributor, or may be separate from the guide members.

BRIEF DESCRIPTION OF THE DRAWINGS

The above and other objects and features of the invention will be apparent from the description of the embodiments taken with reference to the accompanying drawings in which.

DETAILED DESCRIPTION OF THE EMBODIMENTS

A wire forcing device of the present invention is mounted on a distributor of a wire take up apparatus. In the first embodiment, the wire engaging means comprises a pair of guide members on the distributor, and in the second embodiment, wire engaging means comprises a member separate from the guide members of the distributor.

Figure 1:
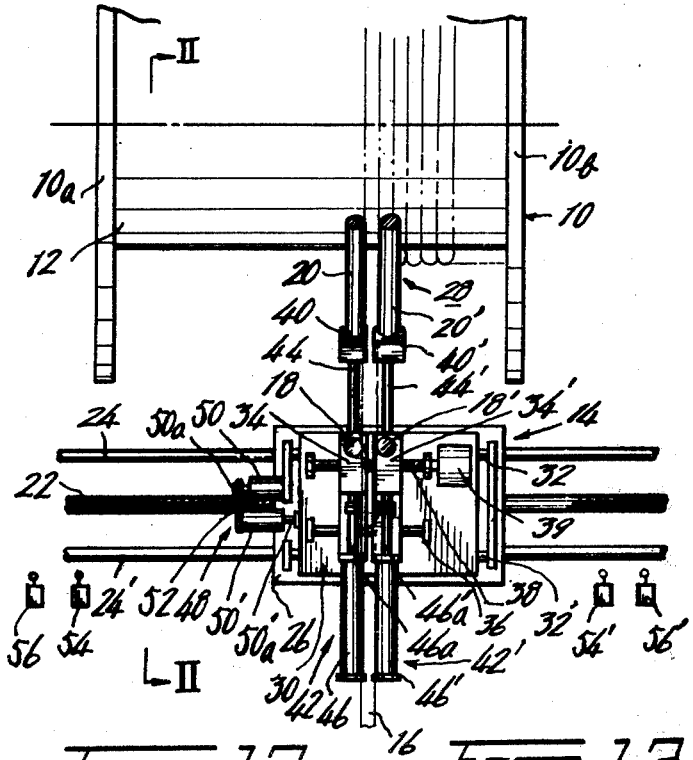
FIG. 1 is a top view of a wire take up apparatus comprising a wire forcing device in accordance with a first embodiment of the present invention.
Figure 2:
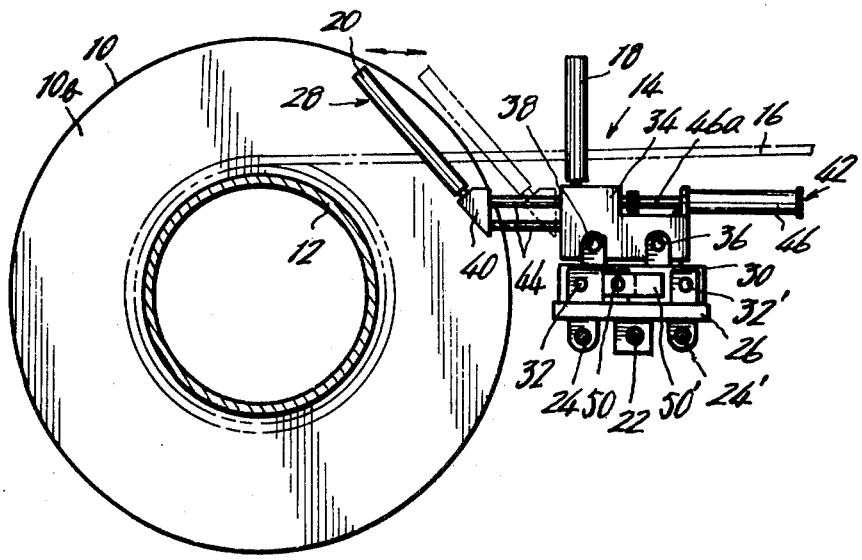
FIG. 2 is a cross sectional view of the wire take up apparatus taken along the line II—II of FIG. 1.

FIGS. 1 and 2 show a typical first embodiment of the present invention. A distributor 14 in front of a reel 10 transversely guides a wire 16 onto a drum 12 of the reel 10 so that the wire is wound onto the reel in an arranged manner. The distributor 14, as conventional, may comprise two pairs of guide rollers 18 and 18', 20 and 20' between which the wire 16 passes. The guide rollers may be mounted on a carriage 26 which is movable along guide rods 24 and 24' on a direction parallel to the axis of the reel 10 by rotation of a feeding screw 22. Thus, each time each turn of the wire 16 is wound onto the drum 12 of the reel 10, the wire is transversely fed a distance corresponding to the diameter of the wire by the distributor so as to be wound on the reel 10 in an arranged manner. In the illustrated embodiment, the rear pair of guide rollers 18 and 18' may be vertically disposed, while the front pair of guide rollers 20 and 20' may be preferably inclined in their axes so that their top ends are located on the upper side of the drum of the reel 10.

A wire forcing device 28 of the present invention includes a wire engaging means comprising a front pair of inclined guide rollers 20 and 20' of the distributor 14. An auxiliary carriage 30 may be supported on the carriage 26 so that the auxiliary carriage 30 may be movable relative to the carriage 26 along a pair of guide rods 32 and 32' a short stroke in a direction parallel to the axis of the reel 10. Guide blocks 34 and 34' which may rotatably support the guide rollers 18 and 18' may be supported on the auxiliary carriage 30 so that the guide blocks may be movable in a direction parallel to the axis of the reel 10 by a guide rod 36 and a screw 38 both extending through the guide blocks 34 and 34'. The inclined guide rollers 20 and 20' may be rotatably supported on a supporting blocks 40 and 40' which may be in turn supported on the respective guide blocks 34 and 34' through position adjustment means 42 and 42'. The position adjustment means 42 and 42' may comprise guide rods 44 and 44' slidably extending through the respective guide blocks 34 and 34' and which has the supporting blocks 40 and 40' secured to the front ends of the guide rods 44 and 44', and air cylinders 46 and 46' mounted on the respective guide blocks 34 and 34' and which further have piston rods 46*a* and 46'*a* connected respectively to the guide rods 44 and 44'. The air cylinders 46 and 46' may have the respective piston rods individually extended and retracted by means of a controller which will be described later. Thus, it will be understood that the guide rollers 20 and 20' of the wire engaging means may be individually movable between an advanced position in which the guide rollers 20 and 20' are faced with flanges 10*a* and 10*b* of the reel 10 as indicated by a solid line in FIG. 2 and a retracted position in which the guide rollers 20 and 20' are located out of the reel flanges 10*a* and 10*b*. As shown in FIG. 1, the screw 38 has the right and left halves reversely threaded and may be connected to an electric motor 39 mounted on the auxiliary carriage 30. Thus, it will be understood that when the electric motor 39 rotates in one direction, the guide rollers 18 and 18', 20 and 20' are spaced in their distance so as to allow the wire 16 to be inserted into the space between the guide rollers 18 and 18', 20 and 20' , and that when the electric motor 39 rotates in the other direction, the guide rollers 18 and 18', 20 and 20' are close to each other so as to hold the wire 16 therebetween.

Urging means 48 urges the wire engaging means against either of the reel flanges when the wire 16 begins to be wound as a first turn of a new winding layer adjacent to either of the reel flanges. In the illustrated embodiment, the urging means 48 may comprise two air cylinders 50 and 50' having piston rods 50*a* and 50'*a* arranged in a reverse direction to each other. The air cylinder 50 may be mounted on the carriage 26, and the air cylinder 50' may be supported on the piston rod 50*a* of the air cylinder 50 through a supporting arm 52, with the piston rod 50'*a* connected to the auxiliary carriage 30. Thus, it will be understood that when the wire 16 may be raised up as a new winding layer adjacent the reel flange 10*a*, for example, if the piston rod 50*a* of the air cylinder 50 is extended, then the guide roller 20' is urged to force the wire 16 against the reel flange 10*a*, and that when the wire 16 is raised up as a further new winding layer adjacent the reel flange 10*b*, if the piston rod 50'*a* of the air cylinder 50' is extended, then the guide roller 20 is urged to force the wire 16 against the reel flange 10*b*.

A controller which controls the operation of the position adjustment means 42 and 42' and the urging means 48 may include first position detectors 54 and 54' and second position detectors 56 and 56'. The first position detectors 54 and 54' may be positioned adjacent the reel flanges 10*a* and 10*b*, respectively, so that they are operated by respective lugs (not shown) on the carriage 26 just prior to engagement of the guide rollers 20 and 20' with the respective reel flanges 10*a* and 10*b*. The second position detectors 56 and 56' may be positioned outside the respective first position detectors, so that they are operated by the same respective lugs when the wire 16 engages the reel flanges 10*a* and 10*b* and begins to be raised up or is raised up as a new winding layer. The first and second position detectors may comprise a microswitch or a proximity switch, and are preferably adjustable in position in a direction parallel to the axis of the reel 10 based on the diameter of the wire 16 to be taken up. The first position detectors 54 and 54' generate an electrical signal to operate the position adjustment means 42 and 42' so as to cause the guide rollers 20 and 20' to retract from the solid line position to the two dot chain line position of FIG. 2 or advance in a reverse manner, and the second position detectors 56 and 56' generate an electrical signal to operate the urging means 48 so as to cause the wire force against the reel flanges 10*a* and 10*b* (see FIG. 3).

Figure 3:
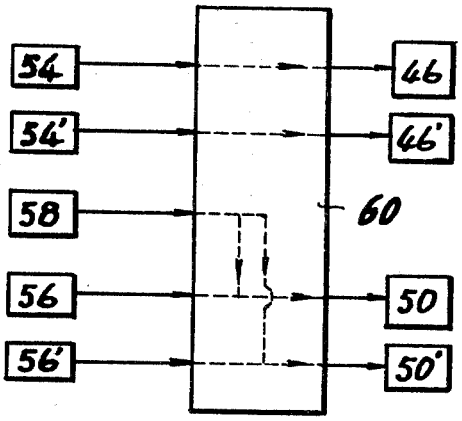
FIG. 3 is a block diagram of a controller used in the device of FIG. 1.

In operation, normally the inclined guide rollers 20 and 20' both have the advanced position as indicated by the solid line in FIG. 2 and the wire 16 is wound onto the reel 10 while it passes between the guide rollers 18 and 18', 20 and 20' and is guided adjacent the point where the wire is wound onto the drum 12 of the reel 10. When the wire 16 nearly reaches the reel flange 10*a*, the electrical signal from the first position detector 54 causes the position adjustment means 42 to be operated to retract the inclined guide roller 20 on the side of the reel flange 10*a* to the position as indicated by the two dot chain line in FIG. 2. Thus, it will be noted that the wire 16 further approaches the reel flange 10*a* by leftward movement of the carriage 26 as viewed in FIG. 1. In the position of the wire 16 adjacent the reel flange 10*a*, the last turn of the present winding layer of the wire terminates at a distance equal to a half of the diameter of the wire 16 from the reel flange 10*a*, and a first turn of a new winding layer seats on a valley between the last turn of the underside winding layer and the reel flange 10*a*. As the new winding layer begins to be wound, the second position detector 56 generates an electrical signal, which causes the piston rod 50*a* of the air cylinder 50 of the urging means 48 to extend to bias the auxiliary carriage 30 in a leftward direction as viewed in FIG. 1, so that the inclined guide roller 20' forces the wire 16 against the flange 10*a* of the reel 10 while the first turn of the new winding layer is being wound. Thus, it will be noted that the wire 16 can be prevented from its movement away from the reel flange 10*a* which tends to occur due to its torsional rigidity, thereby effectively preventing winding disorders. The electrical signal from the second position detector 56 may also instruct a reel rotating angle detector 58 (FIG. 3) such as a counter to count pulses from a pulse generator (not shown) to be operated. The reel rotating angle detector 58 generates an electrical signal when the first turn of the new winding layer terminates namely when the reel 10 rotates nearly one revolution. The electrical signal causes the piston rod 50*a* of the air cylinder 50 to retract to the original position. Thus, at the end of the first turn of the new winding layer the force by which the wire 16 is urged against the reel flange 10*a* is removed and another controller (not shown) causes the distributor 14 to reversely move in a rightward direction as viewed in FIG. 1. Thus, the carriage 26, move in a rightward direction, and therefore, the first position detector 54 does not now operate so that the wire 16 is wound onto the reel 10 while it is transversely guided in the normal manner. The movement of the carriage 26 causes the cylinder 46 to be operated to return the roller 20 to its original position, because the detector 54 is no longer engaged when the carriage 26 moves rightwardly. Since the wire 16 nearly reaches the other reel flange 10*b*, the wire forcing device is operated by the position detectors 54 and 56' in a manner substantially identical to that of the foregoing operation. In FIG. 3, a numeral 60 schematically designates a control system of an electro-magnetic valve which controls a pneumatic system for the air cylinders 46, 46', 50 and 50' by the electrical signals from the position detectors 54, 54', 56 and 56' and the reel rotating angle detector 58.

Figure 4:
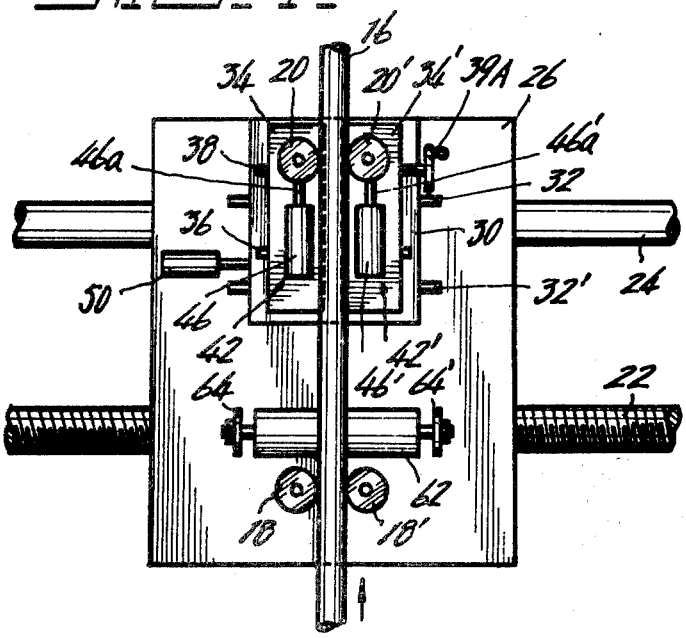
FIG. 4 is a top view of a modification of the wire forcing device of FIG. 1.
Figure 5:
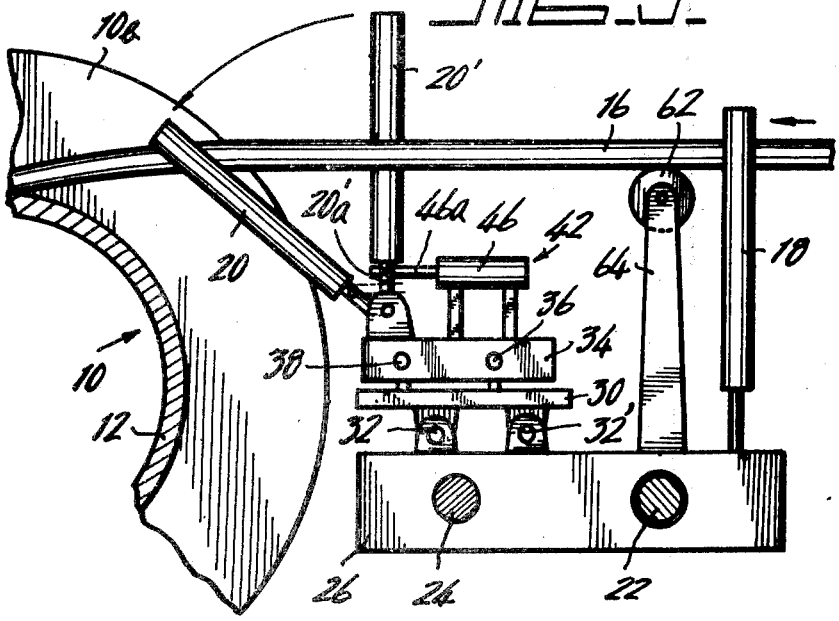
FIG. 5 is a side view of the device of FIG. 4.

FIGS. 4 and 5 show a modification of the invention which is substantially identical to the embodiment of FIGS. 1 to 3, except that the guide rollers 20 and 20' of the wire engaging means are normally positioned rearwards out of the space between the flanges 10*a* and 10*b* of the reel 10, so that either of the guide rollers 20 and 20' may be advanced when the wire is forced against the corresponding reel flange 10*a* or 10*b*. The same components are designated by the same numerals. In this modification, the guide rollers 20 and 20' of the wire engaging means at their shafts 20*a* and 20'*a* may be pivotally mounted on the respective guide blocks 34 and 34' and the piston rods 46*a* and 46'*a* of the air cylinders 46 and 46' of the position adjustment means 42 and 42' may be pivotally connected to the shafts 20*a* and 20'*a*, respectively. An electrical signal from first position detectors (not shown) corresponding to the first position detectors 54 and 54' causes the position adjustment means 42 and 42' to operate so that the guide roller 20 and 20' of the wire engaging means advances and contacts the reel flange 10*a* or 10*b*. The operation of the modification is omitted because it will be understood by those skilled in the art. In this modification, the guide rollers 18 and 18' may be mounted directly on the carriage 26, but not on the guide blocks 34 and 34', respectively. Also, the electric motor to rotate the screw 38 may be replaced by a handle 39A. A numeral 62 designates a horizontal guide roller rotatably supported on the carriage 26 by brackets 64 and 64'.

Figure 6:
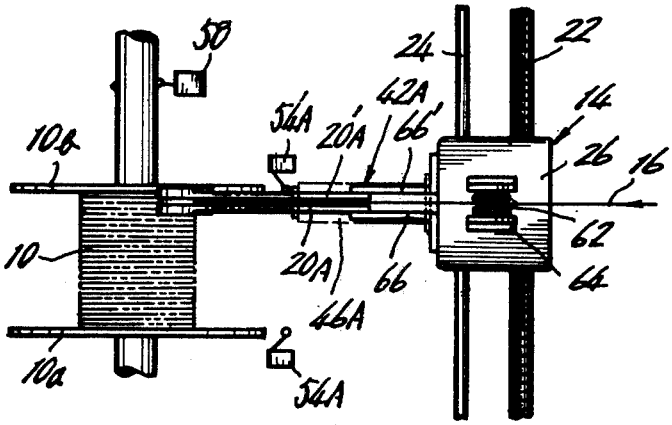
FIG. 6 is a top view of a further modification of the wire forcing device of FIG. 1.
Figure 7:
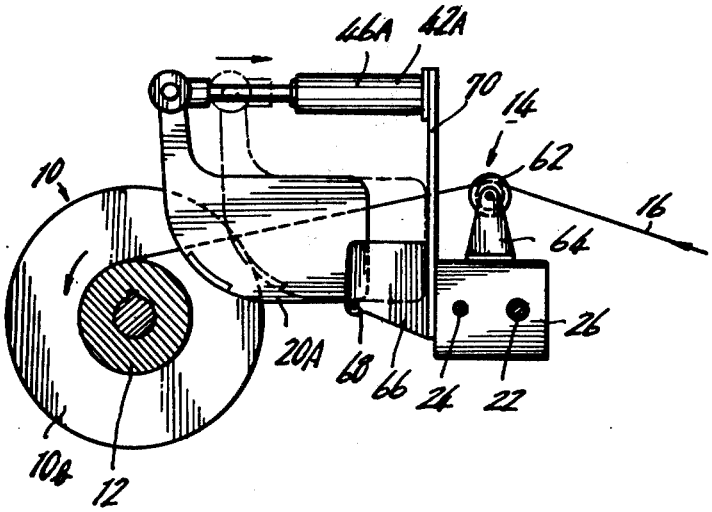
FIG. 7 is a side view of the device of FIG. 6.

In a modification of FIGS. 6 and 7, the wire engaging means may comprise a pair of guide plates 20A and 20'A of the distributor 14, which may be positioned between the flanges 10*a* and 10*b* of the reel 10 during the normal winding operation, but which may be retracted out of the space between the reel flanges 10*a* and 10*b*. The urging means may comprise the feeding screw 22 which serves to transversely move the carriage 26. The guide plates 20A and 20'A may be slidably inserted between two supporting members 66 and 66' securely mounted on the carriage 26 and may be mounted on a pin 68 securely mounted on the supporting members 66 and 66'. The position adjustment means 42A may comprise a single air cylinder 46A which may be securely mounted on a supporting member 70 also secured to the carriage 26, with piston rod of the air cylinders 46A being pivotally mounted on the upper ends of the guide plates 20A and 20'A. A pair of position detectors 54A and 54'A generate an electrical signal in cooperation with the guide plates 20A and 20'A when they nearly approach the reel flange 10*a* or 10*b*. The electrical signal from the position detectors causes the position adjustment means 42A to operate so as to retract the guide plates 20A and 20'A of the wire engaging means as indicated by a two dot chain line in FIG. 2. The reel rotating angle detector 58 may count pulses in response to the electrical signal from the position detectors 54A and 54'A. The distributor 14 is continuously and transversely moved until the reel rotating angle detector 58 counts the number of the pulses corresponding to one revolution of the reel when the last turn of the wire is wound, and then the distributor stops. During the stopping of the distributor, the guide plates 20A and 20'A force the wire against the reel flange 10*a* or 10*b* until winding of the first turn of the new winding layer terminates. As the number of the pulses is counted which corresponds to another revolution of the reel after the winding of the first turn of the new winding layer finishes the distributor 14 is reversely moved. Thus, since the guide plates 20A and 20'A are away from the position detectors 54A and 54'A, the position adjustment means 42A causes the guide plates 20A and 20'A to return to the solid line position of FIG. 7. The movement of the distributor 14 causes the adjustment means 42A to return the plates 20A and 20'A to the original position as shown by the solid lines in FIG. 7. As the distributor 14 is reversed to move toward the reel flange 10*a* from the position of FIG. 7, the plate 20'A moves away from the position detector 54"A, which causes the air cylinder 46A to operate so as to move the plates 20A and 20'A toward the solid line position (original position). In this modification, the guide plates 20A and 20'A are raised so as to pivotally move about the pivotal connection to the piston rod of the air cylinder 46A in accordance with the increment of the winding diameter of the wire 16. The same numerals designate the same components.

Figure 8:
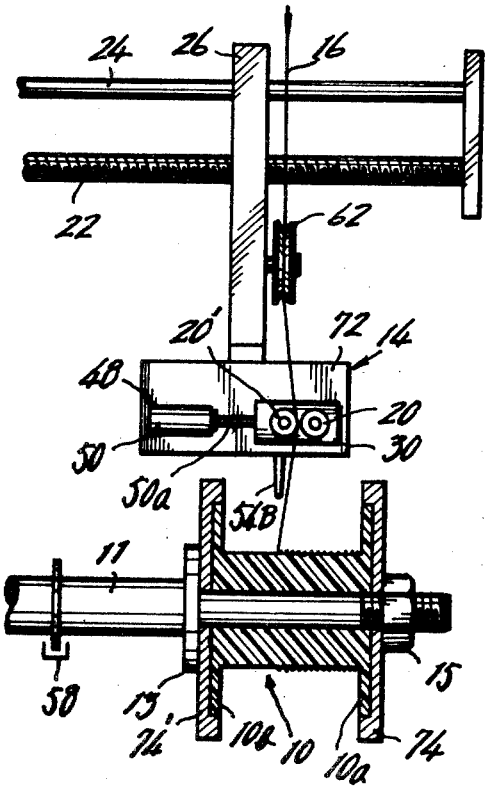
FIG. 8 is a top view of a further modification of the wire forcing device of FIG. 1.
Figure 9:
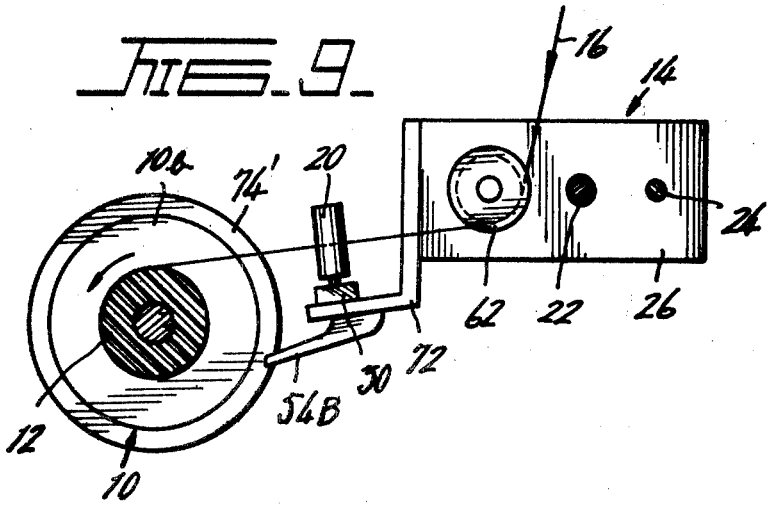
FIG. 9 is a side view of the device of FIG. 8.
Figure 10:
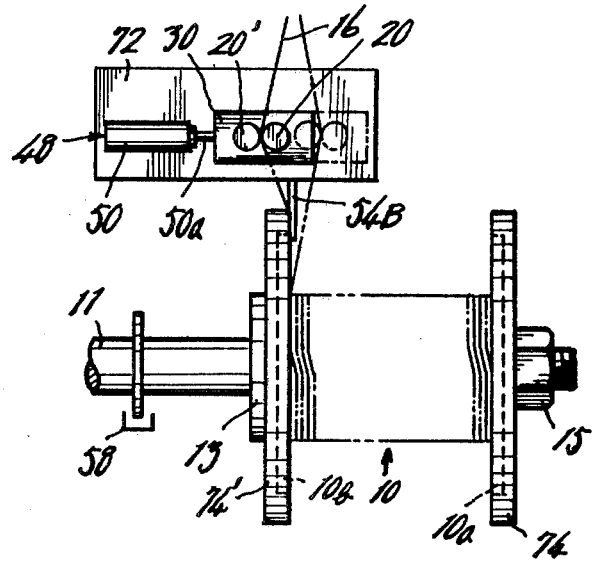
FIG. 10 illustrates the operation of the device of FIG. 8.

In the modification of FIGS. 8 to 10, the wire engaging means may comprise the pair of vertical guide rollers 20 and 20' as in all the aforementioned embodiments, but it serves to force the wire against the flanges 10*a* and 10*b* of the reel 10 outside the space between the reel flanges as in the embodiment of FIGS. 6 and 7. The same numerals designate the same components. The guide rollers 20 and 20' may be rotatably supported on the auxiliary carriage 30, which may be in turn slidably supported by any suitable means (not shown) along the axis of the reel 10 on a L-shaped bracket 72 securely mounted on the carriage 26. The urging means 48 may comprise the air cylinder 50 mounted on the bracket 72, with the piston rod 50*a* of the air cylinder 50 being connected to the auxiliary carriage 30. A position detector 54B may comprise a microswitch mounted on the bracket 72 which has an arm aligned with the point where the wire is being wound on the reel 10. When the position detector 54B engages either of the reel flanges 10*a* and 10*b*, it generates an electrical signal which causes the urging means 48 to be driven. FIG. 10 shows the operation of the device of FIGS. 8 and 9. If the point where the wire is being wound on the reel 10 reaches the flange 10*b* of the reel 10, then the position detector 54B operates to generate an electrical signal, which causes the piston rod 50*a* of the air cylinder 50 of the urging means to retract. Thus, as shown in FIG. 10, the guide rollers 20 and 20' between which the wire is held are moved out of the reel flange 10*b* to force the wire against the reel flange 10*b*. The reel rotating angle detector 58 initiates operation by the electrical signal from the position detector 54B. As it counts the number of the pulses corresponding to one revolution of the reel when the first turn of the new winding layer terminates winding it generates an electrical signal, which causes the urging means to move the guide rollers 20 and 20' to the position as indicated by a two dot chain line in FIG. 10. In this modification, the guide rollers 20 and 20' may be normally retarded relative to the point where the wire 16 is being wound, as shown in FIG. 8, so as to engage the wire against the side of the adjacent turn of the wire on the reel. Thus, it will be noted that the urging means 48 also serves to rapidly feed or return the guide rollers 20 and 20' adjacent either of the flanges of the reel. In the illustrated embodiment, the reel 10 may be of plastics and may be preferably provided with metal covers 74 and 74' which serve to protect the flanges 10*a* and 10*b*, and which may be held in position between a flange 13 on a reel shaft 11 and a nut 15 threadedly engaged with the reel shaft.

Figure 12:
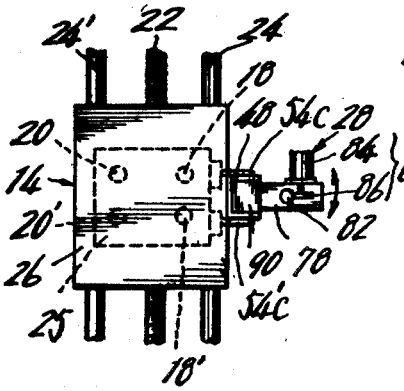
FIG. 12 is a top view of the distributor of FIG. 11.
Figure 11:
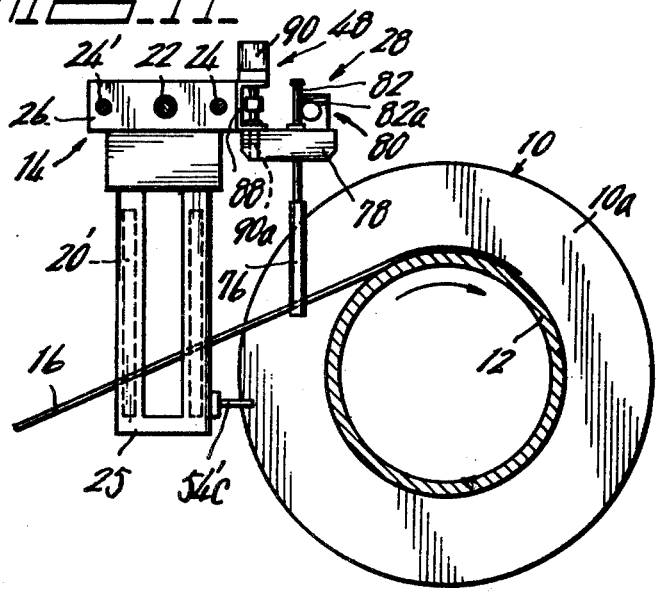
FIG. 11 is a side view of a distributor of a wire take up apparatus comprising a wire forcing device in accordance with a second embodiment of the present invention.

FIGS. 11 and 12 show a typical second embodiment of the present invention wherein the distributor 14 may be of a roller suspending type in which the pairs of guide rollers 18 and 18', 20 and 20' are rotatably supported on a roller frame 25.

Figure 13:
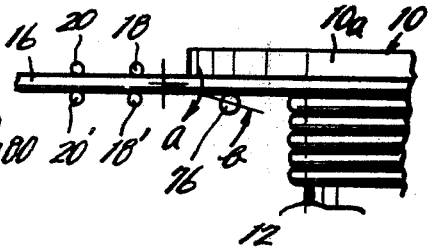
FIG. 13 illustrates the operation of the wire forcing device of FIG. 11.

The wire forcing device 28 is provided with wire engaging means comprising a single wire engaging roller 76 separate from the guide rollers of the distributor 14 and vertically disposed. The wire engaging roller 76 may be mounted on a bracket 78 through position adjustment means 80. The position adjustment means 80 may comprise a lowering shaft 82 journalled on the bracket 78, the wire engaging roller 76 being secured to the lower end of the lowering shaft 82 and a rack 82*a* being provided on the upper end of the lowering shaft 82, and a pinion 86 being secured to an output shaft of an electrical motor 84 to mesh with the rack 82*a* on the lowering shaft 82. The urging means 48 may comprise a torque actuator 90 mounted on a substantially C-shaped frame 88 which is in turn secured to the carriage 26, the bracket 78 being secured to an output shaft of the torque actuator 90. As noted from FIG. 12, the wire engaging roller 76 may be disposed between the guide rollers of the distributor 14 and the reel 10. Position detectors 54C and 54'C may comprise microswitches secured to the roller frames 25 in a manner in which they are aligned with the guide rollers 18 and 18', respectively. The microswitches serve to detect the approach of the distributor 14 to either of the flanges 10*a* and 10*b* of the reel 10 when they engage the respective flanges of the reel. One of the position detectors 54C generates an electrical signal which causes the actuator 90 of the urging means 48 to be actuated. Then, the wire engaging roller 76 rocks in a clockwise direction as indicated by an arrow a in FIG. 13 so as to be inside of the flange 10*a* of the reel 10 in a slightly spaced manner. Thereafter, the electric motor 84 of the position adjustment means 80 is driven so that the wire engaging roller 76 is lowered to the position in which it is faced with the corresponding flange of the reel 10 so as to hold the wire 16 between the wire engaging roller 76 and the corresponding flange of the reel 10 (FIG. 13). After that, the actuator 90 is actuated in a reverse direction so that the wire engaging roller 76 rocks in a counterclockwise direction as indicated by an arrow b in FIG. 13 so as to force the wire 16 against the corresponding flange of the reel 10. As the position detector 54'C which corresponds to the other flange of the reel 10 operates, the urging means 48 causes the wire engaging roller 76 to rock in a counterclockwise direction as viewed in FIG. 12. Thereafter, the position adjustment means 80 causes the wire engaging roller 76 to be lowered and then the urging means 48 causes the wire engaging roller 76 to rock in a clockwise direction to force the wire 16 against the flange 10*b* of the reel 10.

Figure 14:
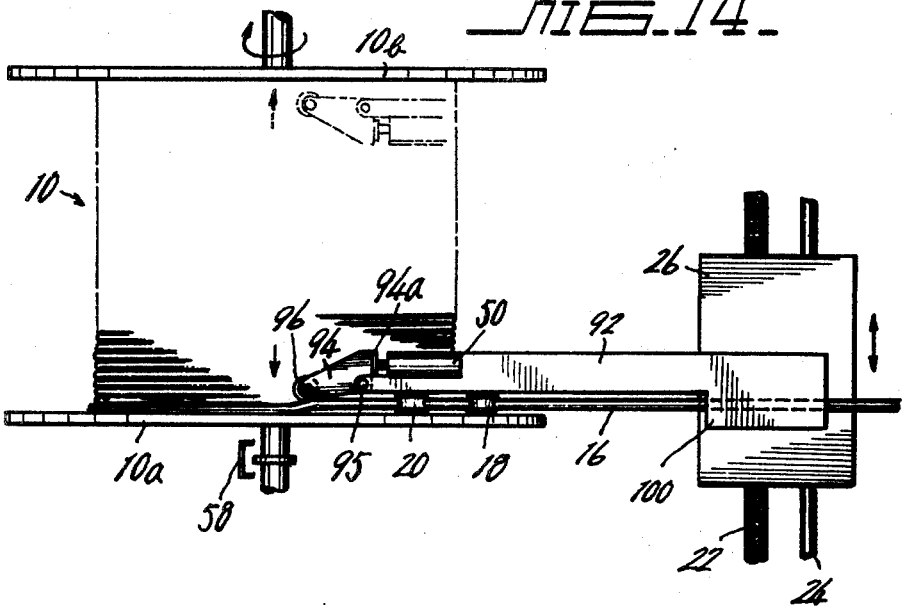
FIG. 14 is a top view of a modification of the wire forcing device of FIG. 11.
Figure 15:
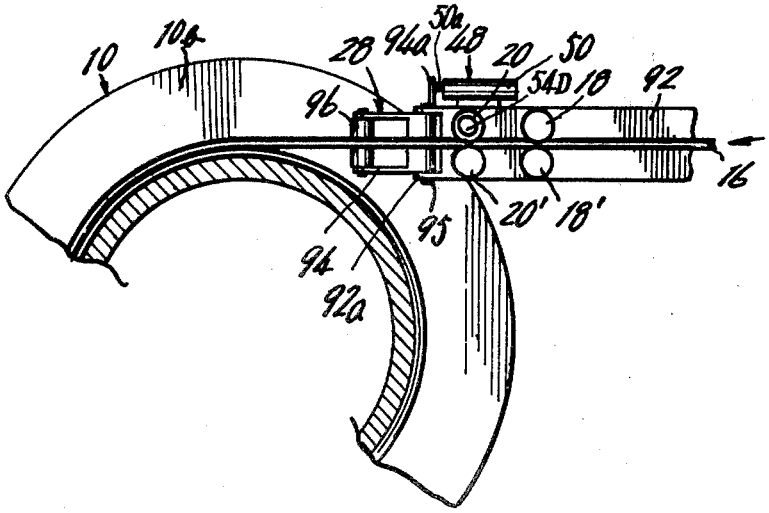
FIG. 15 is a side view of the device of FIG. 14.

In the modification of FIGS. 14 and 16, the distributor 14 may comprise the guide rollers 18 and 18', 20 and 20' mounted on the one side of a front end of an elongated arm 92 extending forwardly from the carriage 26, and the wire forcing device 28 comprises a single wire engaging roller 96 separate from the guide rollers 18 and 18', 20 and 20' as in the embodiment of FIGS. 11 to 13 and mounted on the elongated arm 92 at the front end thereof. The wire engaging roller 96 may be rotatably supported on a frame 94 which is in turn supported on a bracket 92*a* by a pivotal pin 95, the bracket 92*a* being provided at the front end of the elongated arm 92. The urging means 48 may comprise an air cylinder 50 mounted on the elongated arm 92, with a piston rod 50*a* being connected to a lug 94*a* on the frame 94. A position detector 54D may comprise a proximity switch mounted on one of the front pair of guide rollers 20 and which 20' and generates an electrical signal when it approaches either of the flanges 10*a* and 10*b* of the reel 10. The electrical signal from the position detector 54D causes the piston rod 50*a* of the air cylinder 50 of the urging means 48 to be extended so as to force the wire 16 against either of the flanges 10*a* and 10*b* of the reel 10. The elongated arm 92 may be supported on the carriage 26 through arm rotating means 100 which serves to rotate the elongated arm 92 at the angle of 180° about the axis of the wire 16 as shown in FIG. 14. The elongated arm 92, when rotated at the angle of 180° adjacent to the reel flanges through a known controller (not shown) allows the wire 16 to be fully wound at the point adjacent to the reel flanges and also allows the wire forcing device to be operated.

While some preferred embodiments of the invention have been described and illustrated with reference to the accompanying drawings, it will be understood by those skilled in the art that they are by way of examples, and that various changes and modifications may be made without departing from the spirit and scope of the invention, which is intended to be defined only to the appended claims.

What is claimed is:

1. A distributor for use with a take up apparatus which winds wire onto a reel with flanges at each end, said distributor comprising:

at least one pair of rotatable guide rollers adjacent said reel, one roller on each side of said wire;

carriage means carrying said guide rollers thereon for moving said rollers parallel to the longitudinal axis of said reel;

a single vertically movable wire engaging roller between said guide rollers and said reel;

adjustment means connected to said wire engaging roller for moving said roller up and down beside said wire; and urging means operatively connected to said carriage means and said wire engaging roller for selectively positioning said wire engaging roller on the side of said wire opposite the side of said wire approaching one of said flanges as said wire is wound on said reel and for urging said wire engaging roller and said wire toward said flange approached by said wire after said engaging roller has been positioned next to said wire by said adjustment means.

2. A distributor as claimed in claim 1, wherein said urging means is comprised of:

a torque actuator with an output shaft connected to said carriage means; and a bracket secured to said output shaft.

3. A distributor as claimed in claim 2, wherein:

said adjustment means is comprised of:

a vertical shaft journalled on said bracket, said shaft having a rack on the end thereof, a pinion engaging said rack, and motor means connected to said pinion for rotating said pinion; and said engaging roller is connected to the end of said vertical shaft opposite said rack.

* * * * *